US006332804B2

(12) United States Patent
Kurimoto et al.

(10) Patent No.: US 6,332,804 B2
(45) Date of Patent: Dec. 25, 2001

(54) CONNECTOR

(75) Inventors: Naoya Kurimoto; Yukinori Saka, both of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/726,385

(22) Filed: Dec. 1, 2000

(30) Foreign Application Priority Data

Dec. 3, 1999 (JP) ..... 11-345051

(51) Int. Cl.[7] ..... H01R 3/00
(52) U.S. Cl. ..... 439/489; 439/352; 439/188
(58) Field of Search ..... 439/489, 358, 439/372, 488, 352, 188, 144, 752

(56) References Cited

U.S. PATENT DOCUMENTS 5,102,349 * 4/1992 Kato et al. ..... 439/489
5,174,786 * 12/1992 Kato et al. ..... 439/489
5,820,399 * 10/1998 Shirouzu et al. ..... 439/352
6,027,364 * 2/2000 Fukuda ..... 439/489

FOREIGN PATENT DOCUMENTS 926 773 6/1999 (EP) .

* cited by examiner

*Primary Examiner*—Tulsidas Patel
(74) *Attorney, Agent, or Firm*—Banner & Witcoff, Ltd.

(57) ABSTRACT

A simplified fitting detecting connector is provided. A female housing (20) is provided with a chamber (21) which is open to the anterior and in which coiled springs and a slider (41) are housed. The slider (41) is capable of moving in an anterior-posterior direction within the chamber (21). When the female housing (20) is fitted with a male housing (10), the slider (41) is pushed towards the posterior by the male housing (10), the coiled springs compress, and the slider (41) moves towards the posterior. If the fitting operation is halted part-way through, the spring force of the coiled springs is released, separating the two housings (10 and 20). A locking arm (46) is formed in a unified manner on an upper face of the slider (41). When the two housings (10 and 20) have been correctly fitted together, they are maintained in this state by this locking arm (46).

11 Claims, 8 Drawing Sheets

CONNECTOR

TECHNICAL FIELD

The present invention relates to an electrical connector provided with a fitting detecting function.

BACKGROUND TO THE INVENTION

Conventionally, in order to prevent a device from malfunctioning, connectors used in critical circuits for air bag devices and the like are provided with a means to prevent the incomplete fitting of male and female housings which are fitted together. One example thereof is described in JP-11-185880. This connector is provided with a locking means to maintain male and female housings in a fitted state, and a fitting detecting means having a coiled spring which is compressed as the two housings are fitted together and which stores spring force. If the fitting operation is halted part-way through, the spring force separates the two housings, thereby allowing the incompletely fitted state of the two housings to be detected.

In this connector, the locking means and the fitting detecting means are provided separately. Consequently, the configuration of the connector is complicated and is not conducive to the miniaturisation of the connector.

The present invention has taken the above problem into consideration, and aims to simplify the configuration of a connector provided with a fitting detecting function.

According to the invention there is provided an electrical connector comprising a housing having an anterior side, terminals at the anterior side for engagement with a corresponding connector, and a resilient locking arm having a protrusion engageable with a corresponding connector to maintain said housing in a latched condition, said housing further including a slider having an abutment for contact with a corresponding connector, said slider being movable towards and away from the anterior side, and spring means to urge the slider to the anterior side, wherein locking arm is provided on said slider. Said housing may include a guide for bending said locking arm in response to movement of said slider away from the anterior side, said guide causing said abutment to be released from contact with a corresponding connector at a predetermined stroke of said slider such that said slider moves to the anterior under the force of said spring means, said locking arm being maintained in a bent state until engagement of said protrusion and corresponding connector.

In such a connector all of the movable components are provided on one of the two connector members, thus a relatively simple mating connector can be integrally moulded as part of an electrical component.

The protrusion and abutment are preferably the same, thus the two functions can be combined in a single moulded feature.

In the preferred embodiment the housing is provided with a regulating member for preventing bending of the locking arm during initial movement of the slider, this regulating member disengaging from the locking arm at a predetermined stroke of the slider at which bending of the locking arm is initiated.

The connector housing is preferably also provided with a support member for maintaining the locking arm in a bent condition during movement thereof to the anterior side. The support member and regulating member are preferably constituted by opposite faces of a single moulded feature.

BRIEF DESCRIPTION OF DRAWINGS

Other features of the invention will be apparent from the following description of a preferred embodiment of the invention shown by way of example in the accompanying drawing in which.

DESCRIPTION OF PREFERRED EMBODIMENT

Figure 1:
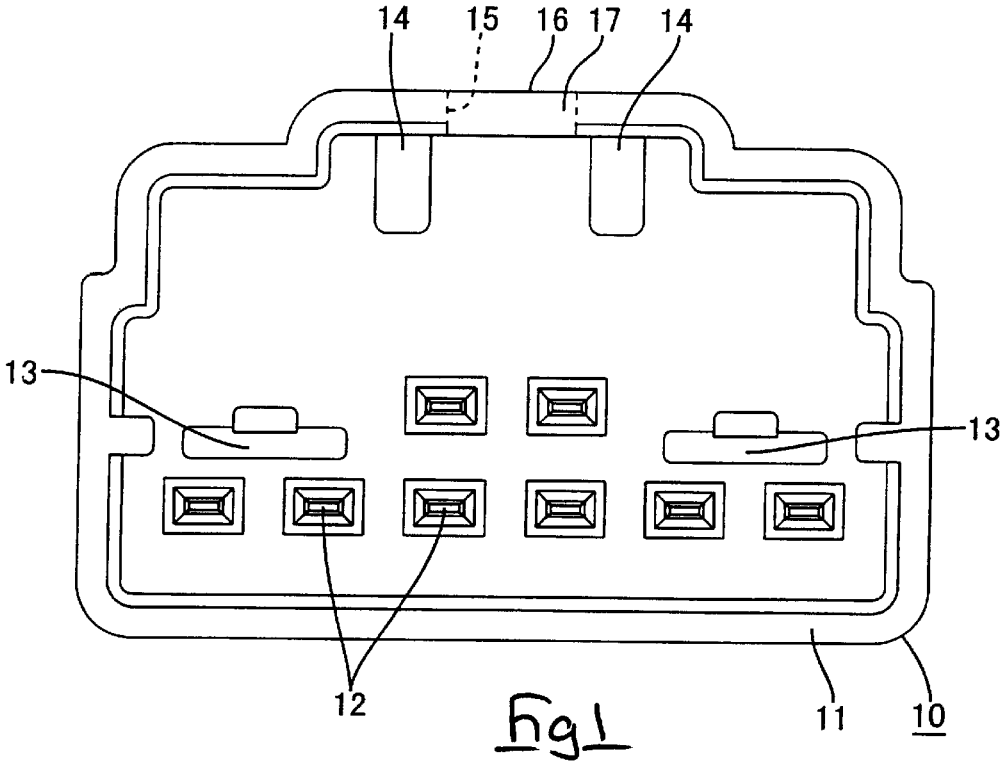
FIG. 1 is a front view of a male housing of an embodiment of the present invention.

An embodiment of the present invention is described below with the aid of FIGS. 1 to 14. As shown in FIG. 5, a connector of the present embodiment is formed from a male connector housing 10 moulded as part of a device, and a female connector housing 20. This female housing 20 fits with the male housing 10. The female housing 20 is provided with coiled springs 40 and a slider 41 which has a locking arm 46 provided in a unified manner therewith. Hereafter, fitting sides of the male and female housings 10 and 20 are considered to be the anterior.

Figure 2:
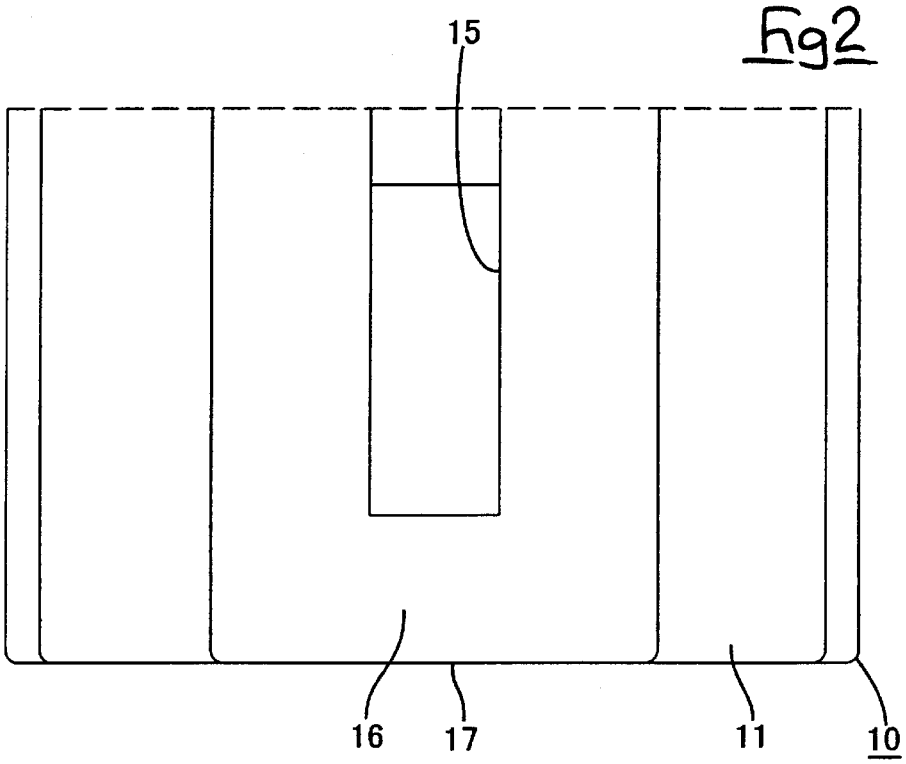
FIG. 2 is a plan view of the male housing.

The male housing 10 has a hood 11 which is open towards the anterior. The female housing 20 fits therein. As shown in FIG. 1, two male terminal fittings 12 are provided so as to protrude from each of an upper and lower layer formed at the centre of the hood 11 (relative to the width-wise direction of the male housing 10). A further two male terminal fittings 12 protrude from the left side of the lower layer, and two other male terminal fittings 12 protrude from the right side of the lower layer. These male terminal fittings 12 protrude in a mutually aligned manner. Short-circuiting releasing members 13 protrude at the left and right of the upper layer. These short-circuit releasing members 13 make contact with short-circuiting terminals 26 of the female housing 20 and release a short-circuiting state of female terminal fittings 22. A pair of guiding ribs 14, which guide protrusions of the female housing 20, protrude inwards into a ceiling face of the hood 11. As shown in FIGS. 2 and 5, a groove 15 is formed on an upper wall of the hood 11 at a location between the two guiding ribs 14. This groove 15 is formed at the posterior, leaving an anterior edge portion which forms a locking member 16 for engaging with a locking arm 46 of the female housing 20.

Figure 3:
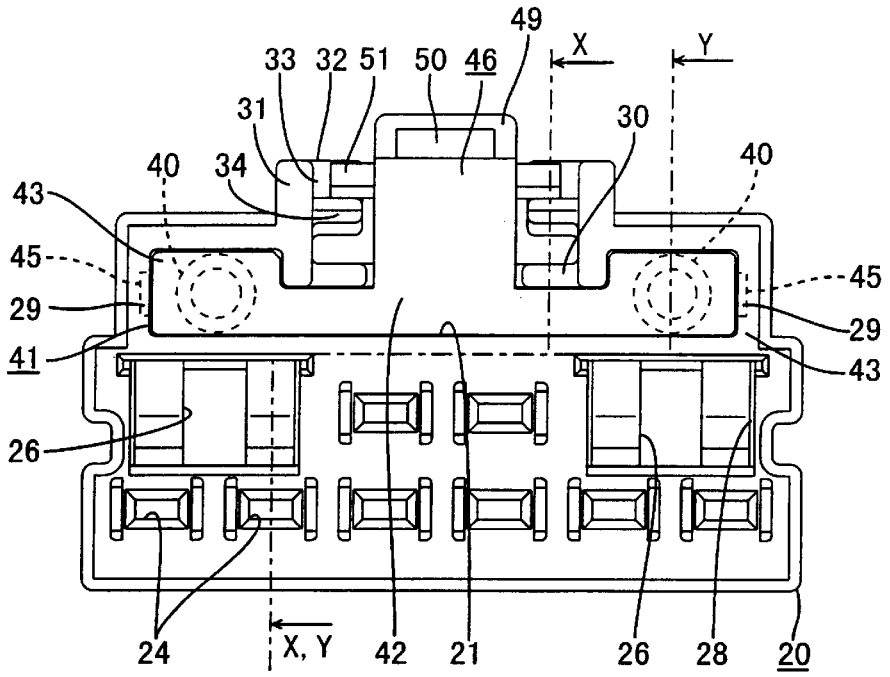
FIG. 3 is a front view of a female housing.

Next, the female housing 20 will be described. As shown in FIG. 3, an approximately upper half of the female housing 20 is formed separately and forms a chamber 21 which houses the coiled springs 40 and the slider 41. Cavities 24 are provided in a lower half of the female housing 20. These cavities 24 house the female terminal fittings 22 and are provided in locations which correspond to the male housing 10. As shown in FIG. 5, each female terminal fitting 22 housed within the cavities 24 is doubly retained. A metal lance 23 of the female terminal fitting 22 is retained by a stopping member (not shown), and a cog of the female terminal fitting 22 fits with a retainer 25 which is attached within the female housing 20 so as to intersect with each cavity 24. To the left and right of the cavities 24 located at the upper layer of FIG. 3 are short-circuiting terminal housing chambers 28 which house the forked short-circuiting terminals 26. Each of these short-circuiting terminal housing chambers 28 joins with the two cavities 24 provided below them. Connecting members 27 of the short-circuiting terminals 26, which pass through this joining portion, make contact with the female terminal fittings 22 within the cavities 24, thereby short-circuiting these two female terminal fittings 22.

Figure 4:
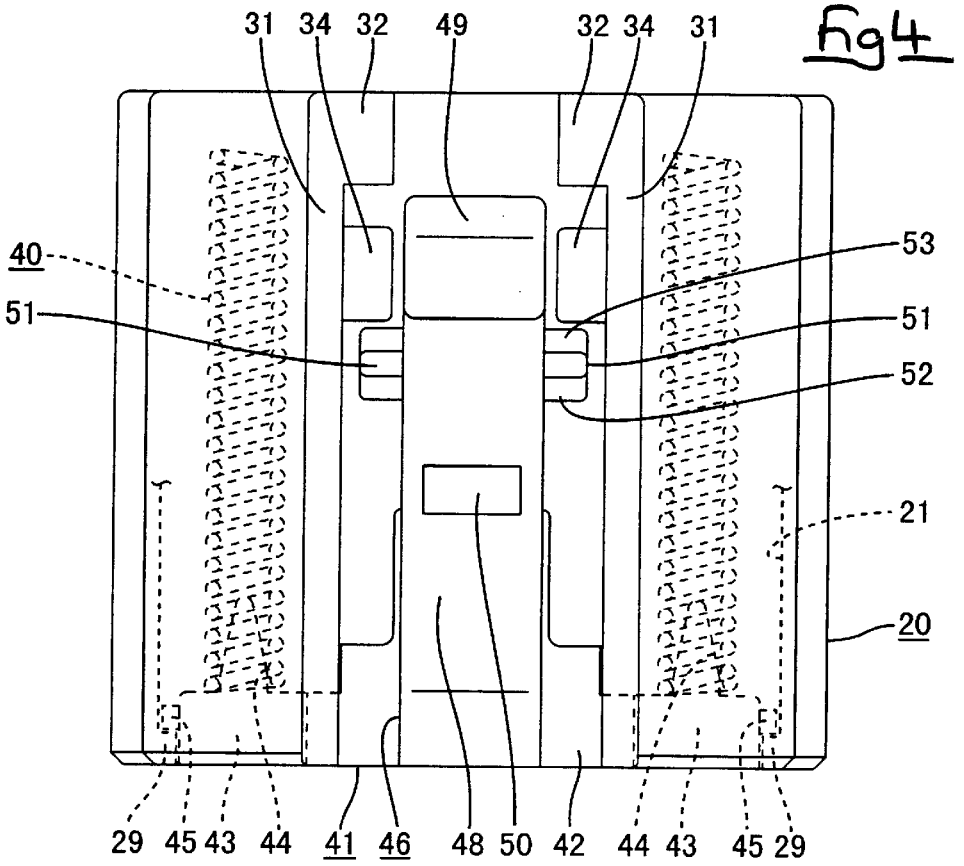
FIG. 4 is a plan view of the female housing.
Figure 5:
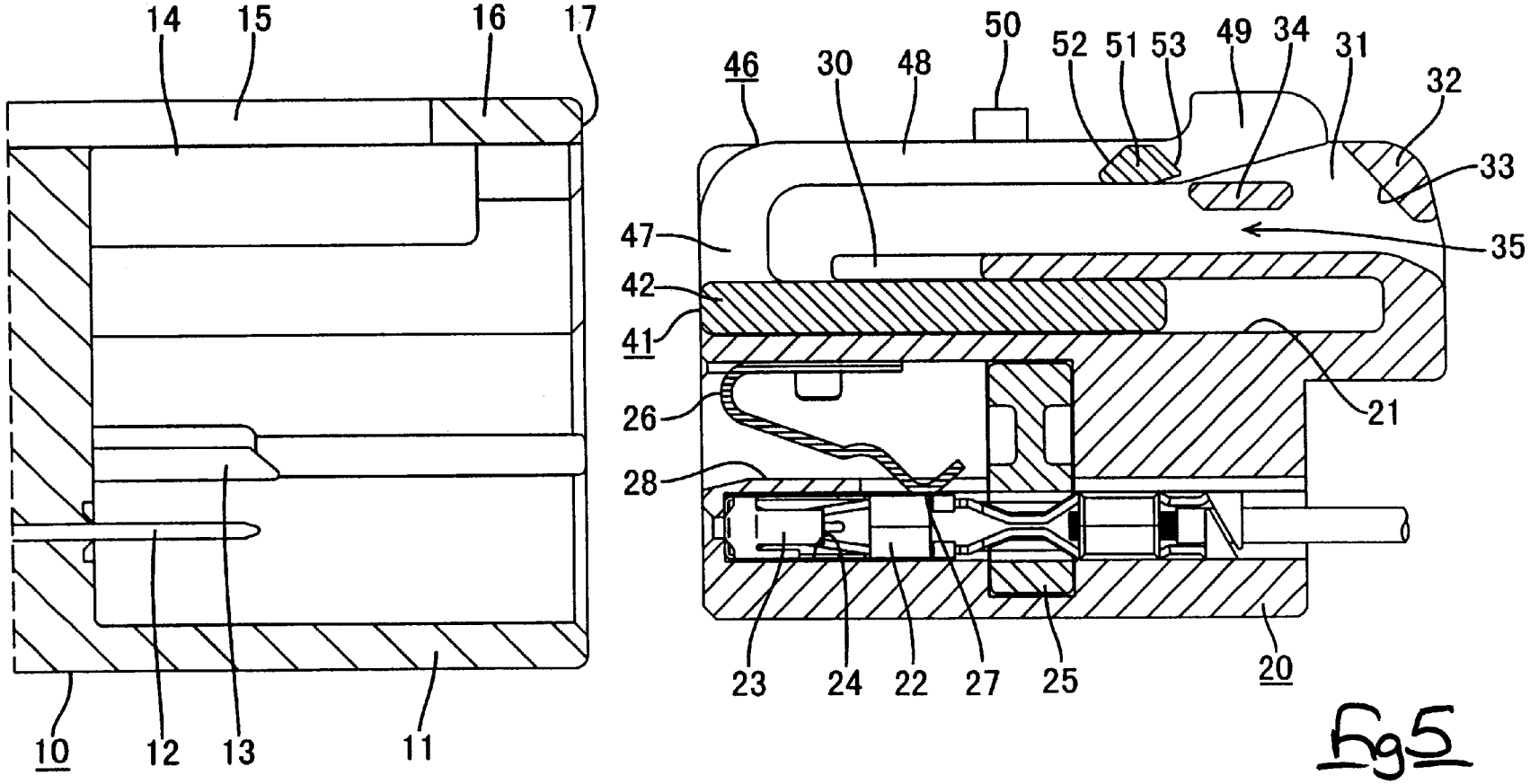
FIG. 5 is a cross-sectional view along the line X—X of the female housing prior to being fitted with the male housing.
Figure 6:
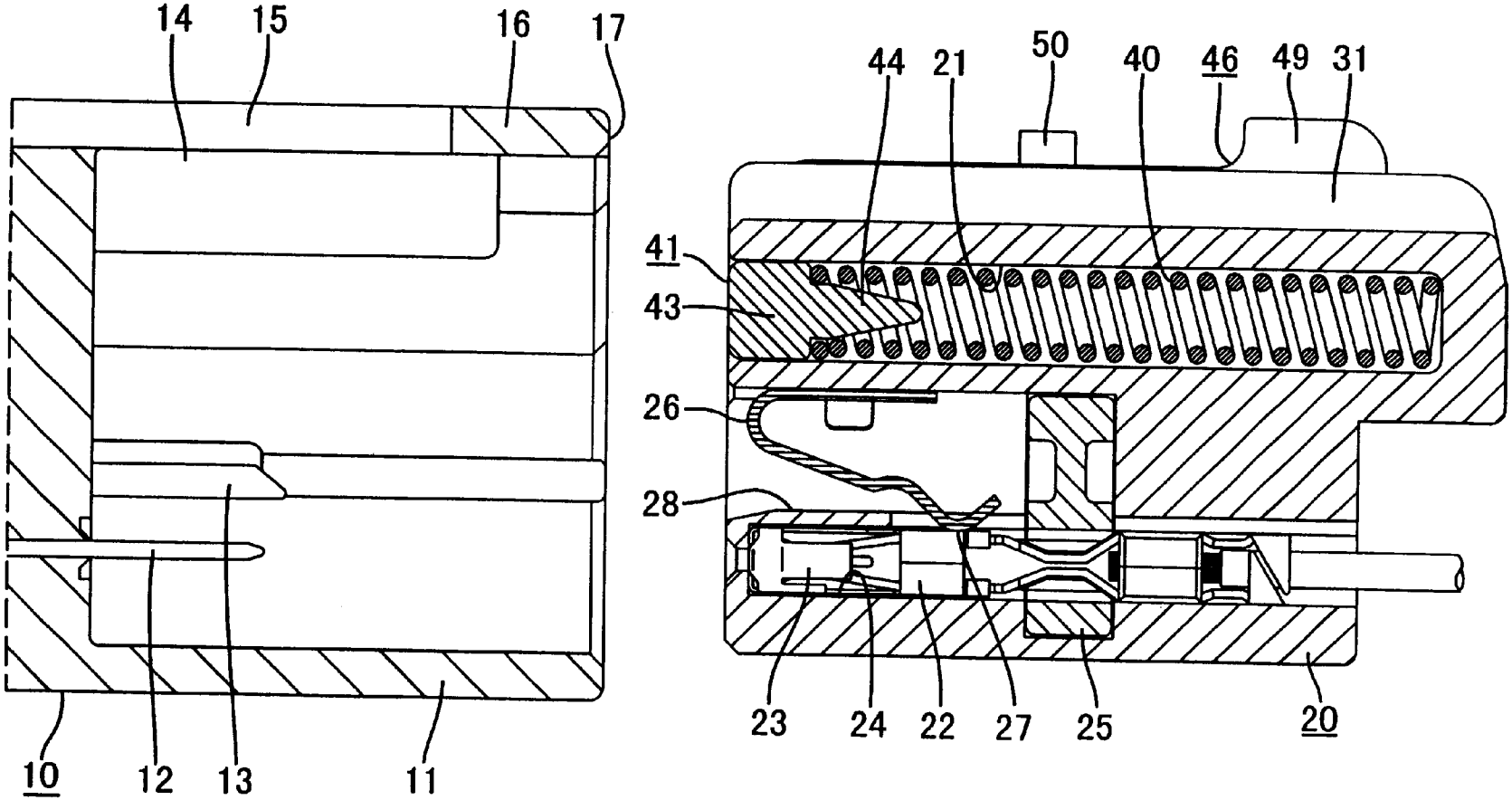
FIG. 6 is a cross-sectional view along the line Y—Y of the female housing prior to being fitted with the male housing.

As shown in FIGS. 3 and 4, the housing chamber 21 is open at its anterior side. A pair of coiled springs 40, which are capable of changing shape resiliently from their anterior, are inserted into a left and right side of the chamber 21. Then the slider 41, which extends along the width of the chamber 21, is inserted therein so as to compress the inserted coiled springs 40.

As shown in FIG. 4, a central portion in a width-wise direction of the slider 41 is provided with a plate-shaped main body 42. Both sides of the main body 42 are provided with spring pressing members 43 which are inserted into the coiled springs 40. These spring pressing members 43 are provided with cone-shaped maintaining members 44. The slider is capable of moving towards the anterior and the posterior within the housing chamber 21 (see FIG. 6). When the slider 41 is in an attached state within the housing chamber 21, it is usually located towards the anterior as a result of the spring force of the coiled springs 40. A pair of anterior stopping protrusions 45 protrude outwards from side faces of both spring pressing members of the slider 41. These anterior stopping protrusions 45 engage with stoppers 29 which protrude inwards at anterior ends of both side faces of the housing chamber 21. The slider 41 is thereby retained in the anterior direction.

As shown in FIG. 5, the cantilevered locking arm 46 protrudes upwards from an upper face of the main body 42 of the slider 41. This locking arm 46 is formed in a unified manner with the slider 41. Consequently, when the slider 41 moves to the anterior or posterior, the locking arm 46 moves with it. Furthermore, a recessed opening 30, which allows the locking arm 46 to pass therethrough, is formed in an upper wall of the chamber 12. As shown in FIG. 3, a pair of side walls 31 are formed on an upper face of the chamber 21 at locations slightly distant from the locking arm 46. These side walls 31 surround the locking arm 46 from the sides. The guiding ribs 14 of the male housing 10 are inserted between the locking arm 46 and the side walls 31.

As shown in FIG. 5, the locking arm 46 is formed from a base end 47, which protrudes from an anterior end of the main body 42, and an arm member 48 which extends towards the posterior from the base end 47. This locking arm 46 is capable of bending, with the base end 47 serving as its centre. As the locking arm 46 bends, the arm member 48 moves downwards. A free end of the arm member 48 is provided with an operating member 49. Pressing this operating member 49 from above causes the locking arm 46 to move.

Figure 7:
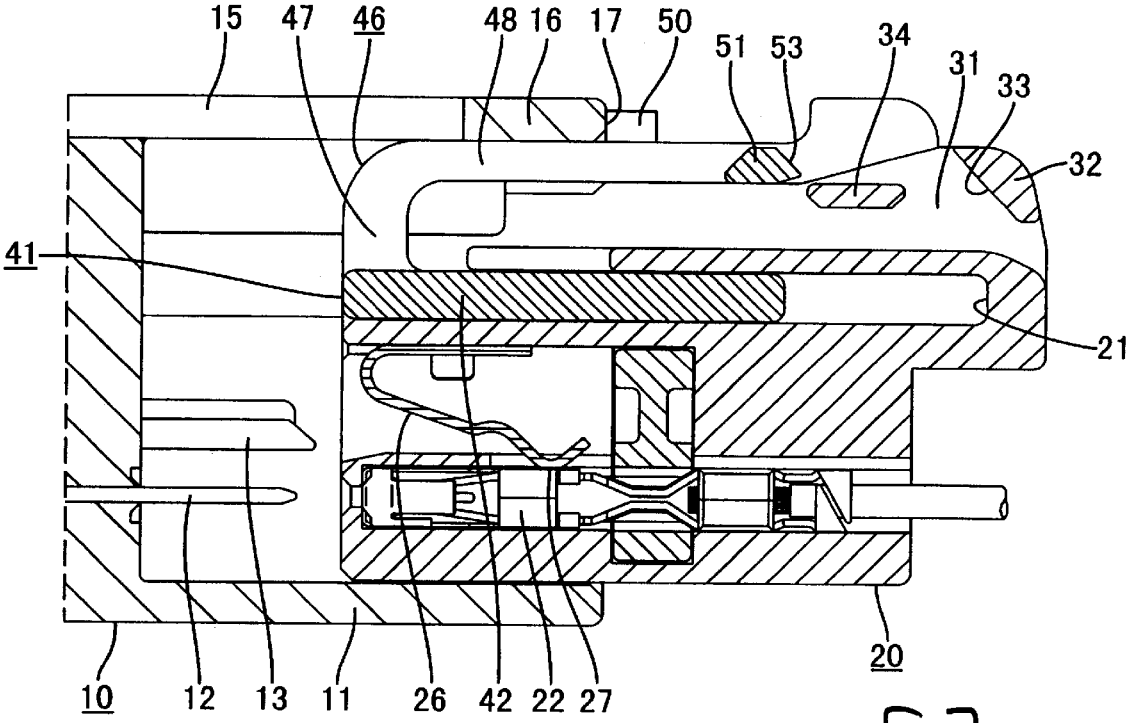
FIG. 7 is a cross-sectional view along the line X—X of the female housing showing a state whereby an anterior end face of a locking member makes contact with a locking protrusion.
Figure 8:
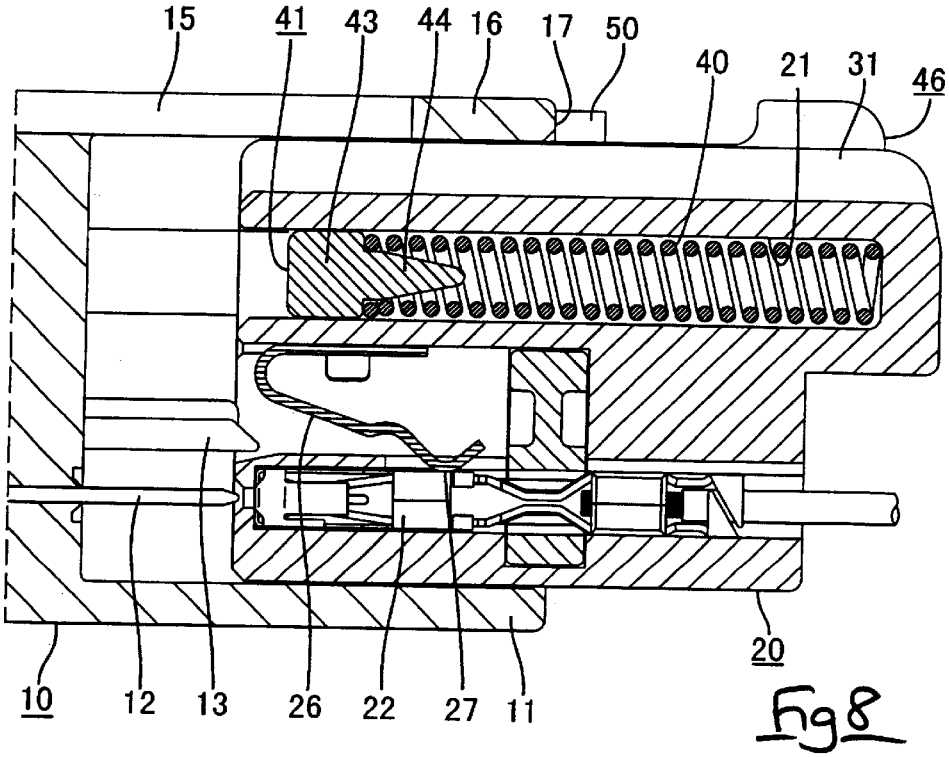
FIG. 8 is a cross-sectional view along the line Y—Y of the female housing showing a coiled spring in a compressed state.
Figure 9:
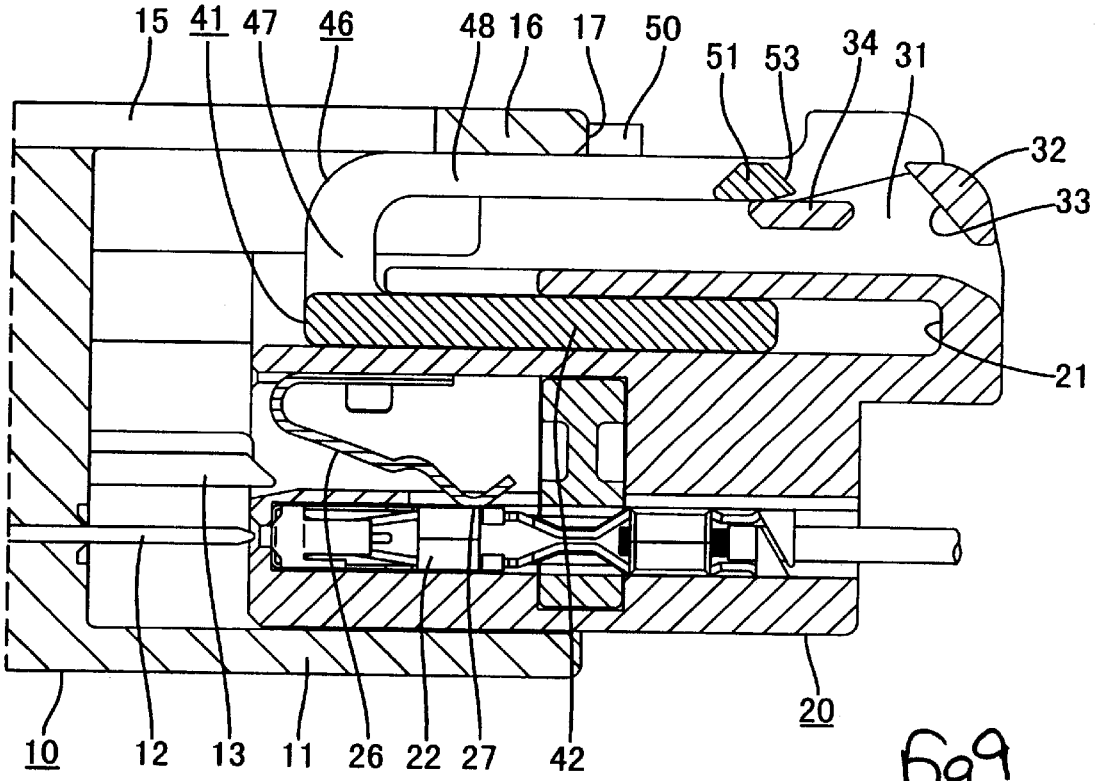
FIG. 9 is a cross-sectional view along the line X—X of the female housing showing the bending of a locking arm being regulated by a regulating member.
Figure 12:
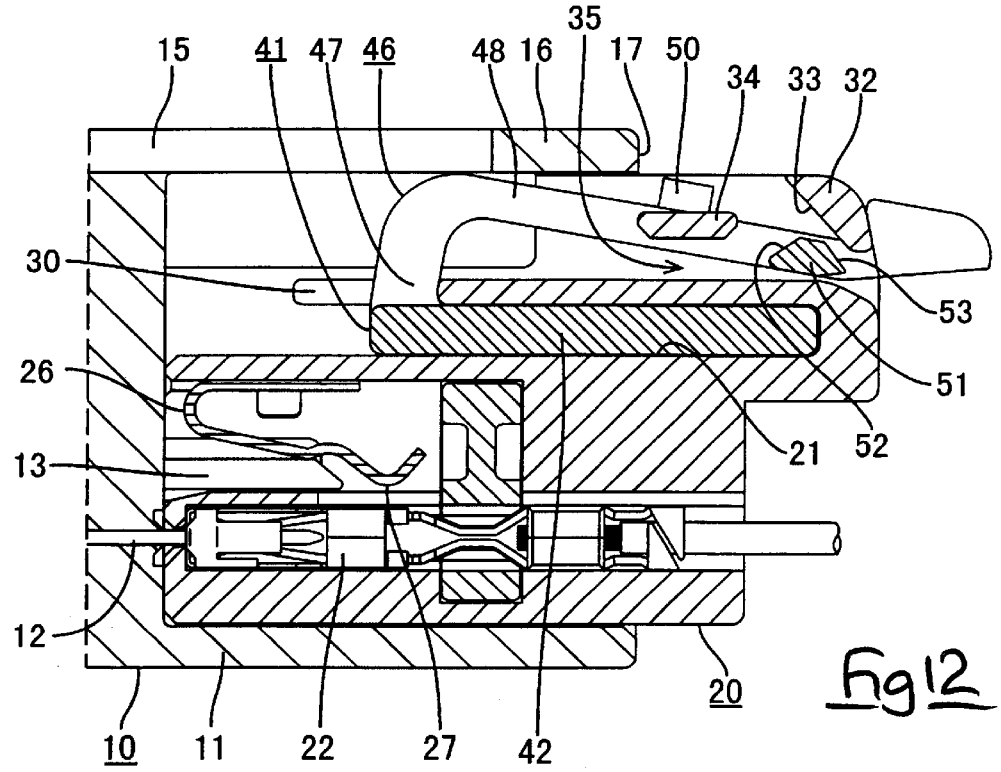
FIG. 12 is a cross-sectional view along the line X—X of the female housing showing the locking arm in a bent state when the two housings have reached a correct fitting depth.

A locking protrusion 50, which is formed on an upper face of the arm member 48, fits with the locking member 16 of the male housing 10. As shown in FIG. 7, the locking protrusion 50 makes contact with an anterior end face 17 of the locking member 16 as the two housings 10 and 20 are fitted together. As this fitting progresses, the locking protrusion 50 is pushed by the anterior end face 17 of the locking member 16. As shown in FIGS. 8 and 9, this pushing causes the slider 41, which is formed in a unified manner with the locking arm 46, to be pushed towards the posterior, simultaneously compressing the coiled springs 40. As shown in FIG. 12, the locking protrusion 50 moves downwards as the locking arm 46 is bent and, when this locking protrusion 50 has moved downwards for a distance corresponding to its own height, its pressed state with the anterior end face 17 of the locking member 16 is released.

As shown in FIG. 4, a pair of stopping protruding members 51 protrude outwards towards the side walls 31 of the housing from left and right side walls of the arm member 48 at a location to the posterior of the locking protrusion 50. As shown in FIG. 5, these stopping protruding members 51 are approximately trapezoid in shape when viewed from the side. Tapered faces 52 and 53 are formed on the left and right sides thereof. As shown in FIG. 4, a pair of guiding members 32 protrude towards the locking arm 46 from posterior end sides of the side walls 31 of the housing. As shown in FIG. 5, guiding faces 33 are provided on the guiding members 32. These guiding faces 33 incline downwards towards the posterior. As the slider 41 (that is, the locking arm 46) is moved to the posterior, the right tapered faces 53 of the stopping protruding members 51 engage with the guiding faces 33. From this state, the stopping protruding members 51 are pressed by the guiding members 32 while the posterior movement of the slider 41 progresses, thereby bending the locking arm 46 (see FIG. 12).

Figure 10:
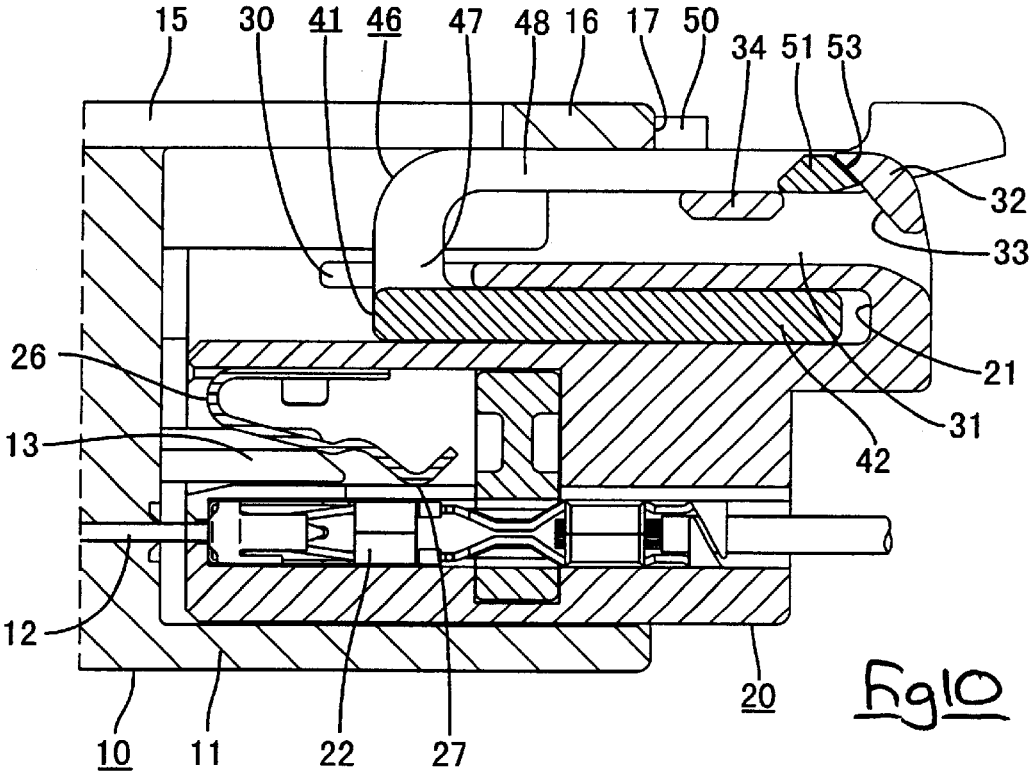
FIG. 10 is a cross-sectional view along the line X—X of the female housing showing a stopping protruding member fitting with a guiding member.

The period during which the guiding members 32 begin to make contact with the stopping protruding members 51 is a period which precedes the point when the two housings 10 and 20 reaching a correct fitting position (see FIG. 10). When the two housings 10 and 20 reach the correct fitting position, the stopping protruding members 51 are no longer guided by the guiding members 32, and the pressed state of the locking protrusion 50 with the anterior end face 17 of the locking member 16 is released (see FIG. 12).

As shown in FIGS. 4 and 5, a pair of supporting/regulating members 34 protrude towards the locking arm 46 from the side walls 31 of the housing at a location to the anterior of the guiding members 32. As shown in FIG. 5, these members 34 are located so that their upper faces are at approximately the same height as lower faces of the stopping protruding members 51 of the locking arm 46. The supporting/regulating members 34 extend from a location directly to the posterior (relative to FIG. 5) of the stopping protruding members 51 to a location slightly to the anterior of the guiding members 32. The posterior ends thereof are located so as to allow the stopping protruding members 51 to be moved downwards by the guiding members 32. That is, the members 34 are provided below the stopping protruding members 51 in the space into which the locking arm 46 is bent by the guiding members 32. This provides a regulating surface 34A which regulates the bending of the locking arm 46 as fitting progresses (see FIG. 9). Moreover, spaces 35, which have a specified height, are formed below the regulating members 34. When the locking arm 46 has been bent to the position shown in FIG. 12, the stopping protruding members 51 pass through these spaces 35 in contact with a supporting surface 34B (FIG. 9). The ramp faces 34C and 52 ensure smooth engagement.

The present embodiment is configured as described above. Next, the operating thereof will be described. As shown in FIG. 7, when the female housing 20 is fitted into the hood 11 of the male housing 10, the anterior end face 17 of the locking member 16 makes contact with the locking protrusion 50 of the locking arm 46. As the fitting operation of the two housings 10 and 20 continues from this state, the locking protrusion 50 is pressed by the anterior end face 17 of the locking member 16.

Consequently, as shown in FIG. 8, the slider 41 moves towards the posterior within the chamber 21, simultaneously compressing the coiled springs 40. At this juncture, after the coiled springs 40 begin to be compressed, the male and female terminal fittings 12 and 22 make mutual contact.

As shown in FIG. 9, the stopping protruding members 51 of the locking arm 46 pass above the supporting/regulating members 34 while the slider 41 moves towards the posterior. As a result, if the locking arm 46 is bent while the stopping protruding members 51 are passing above the regulating members 34, these stopping protruding members 51, which also bend downwards, make contact with the regulating surfaces 34A of the members 34, thereby preventing the locking arm 46 from being bent while fitting is occurring. As shown in FIG. 10, the slider 41 is pushed while the fitting operation progresses until it reaches a location where the stopping protruding members 51 of the locking arm 46 make contact with the guiding faces 33 of the guiding members 32.

Figure 11:
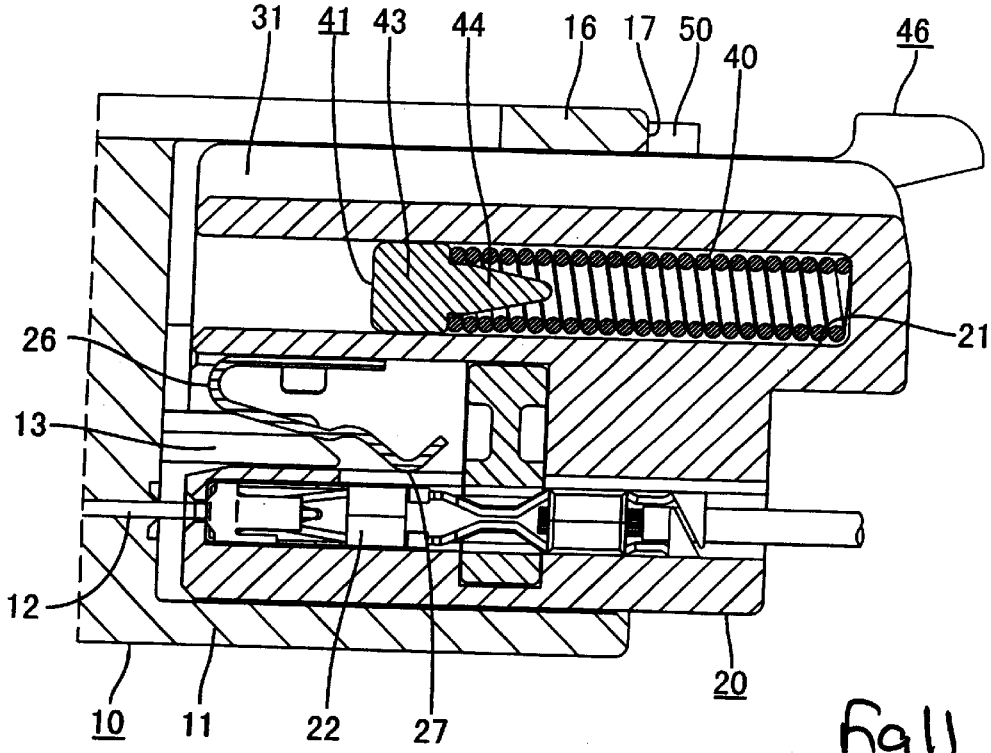
FIG. 11 is a cross-sectional view of the state shown in FIG. 10 along the line Y—Y of the female housing.

As shown in FIG. 11, if the fitting operation is halted part-way through, the spring force which has been accumulated thus far by the compressed springs 40 is released, thereby pushing the slider 41 and the locking arm 46 to the anterior. The two housings 10 and 20 separate as the slider 41 moves to the anterior. By this means, the incompletely fitted state of the two housings 10 and 20 is detected.

As shown in FIG. 10, when the fitting progresses with the stopping protruding members 51 engaging with the guiding faces 33, these guiding faces 33 press the stopping protruding members 51 as the slider 41 and the locking arm 46 move towards the posterior, thereby bending the locking arm 46. The degree of bending of the locking arm 46 increases as the stopping protruding members 51 move downwards along the guiding faces 33. The arm member 48 moves downwards as the locking arm 46 bends, and consequently the engagement of the locking protrusion 50 with the anterior end face 17 of the locking member 16 is gradually released.

As shown in FIG. 12, when the two housings 10 and 20 reach a correct fitting depth, the stopping protruding members 51 are no longer guided by the guiding members 32, and the pressed state of the locking protrusion 50 with the anterior end face 17 of the locking member 16 is released. As a result, the slider 41 is no longer prevented from moving towards the anterior, and the spring force of the compressed coiled springs 40 is released, thereby moving the slider 41 towards the anterior while the locking arm 46 remains in its bent state. At this juncture, the stopping protruding members 51 of the locking arm 46 pass through the spaces 35 below the supporting/regulating members 34.

Figure 13:
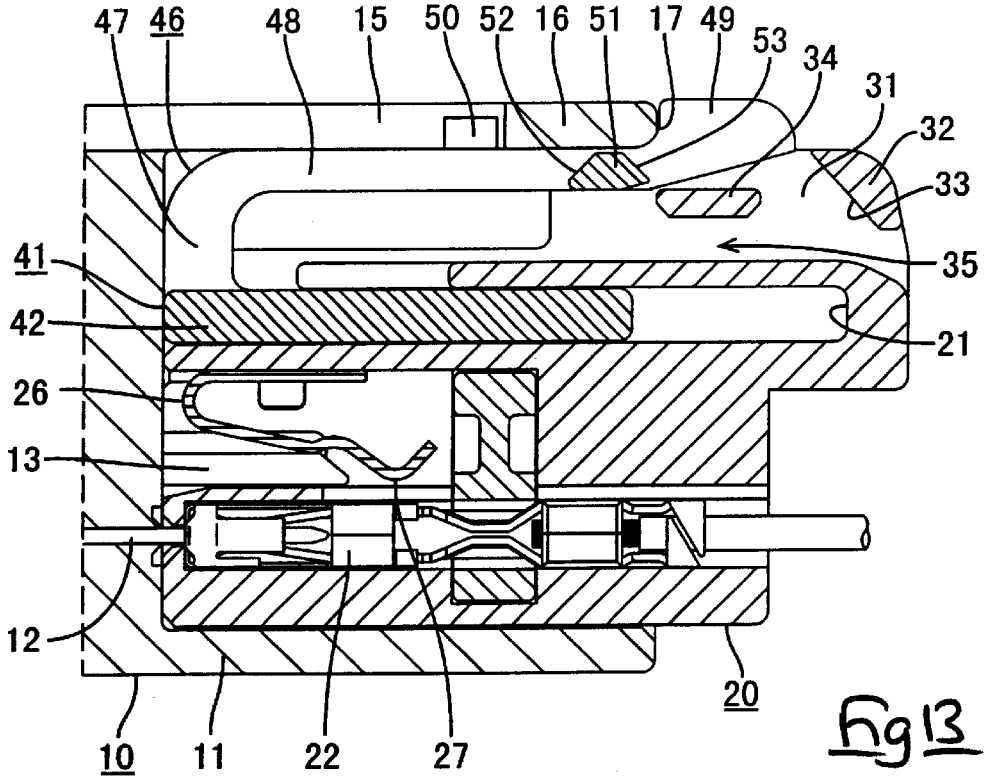
FIG. 13 is a cross-sectional view along the line X—X of the female housing showing the two housings maintained in a fitting state.
Figure 14:
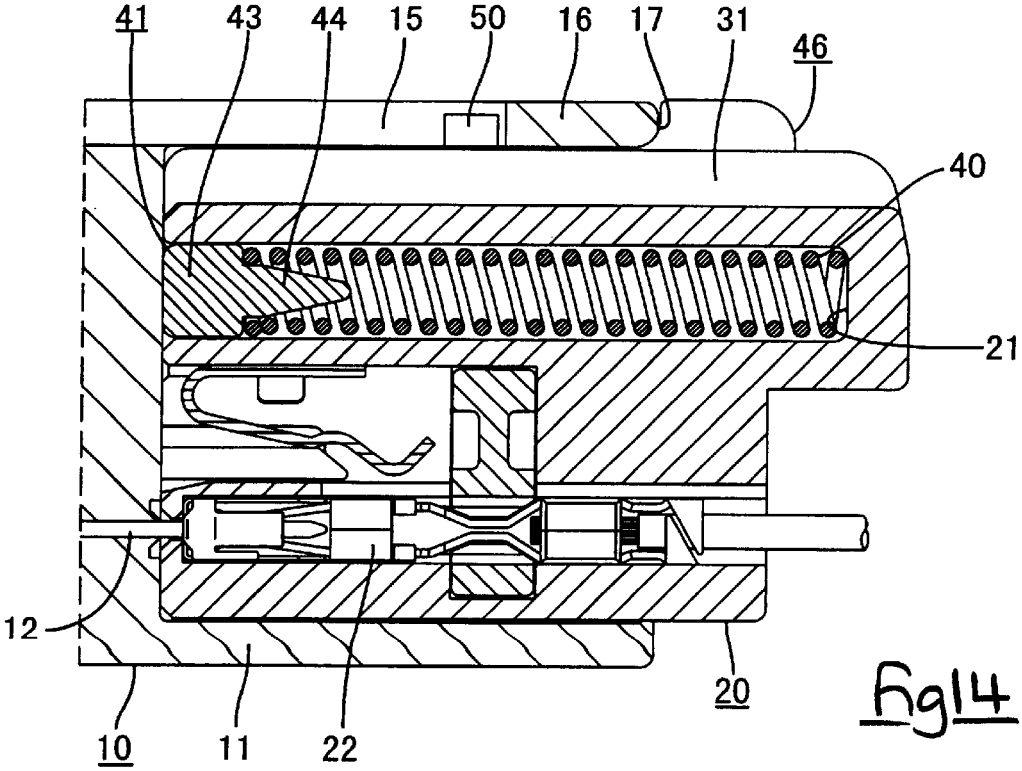
FIG. 14 is a cross-sectional view along the line Y—Y of the female housing showing the coiled spring in a state whereby it has returned to its original pre-fitting length.

As shown in FIG. 13, the locking arm 46 and the slider 41 are moved back to their pre-fitting position, and when the locking arm 46 has returned resiliently to its original position, the locking protrusion 50 fits with the locking member 16 of the male housing 10. By this means, the two housings 10 and 20 are maintained in a state whereby they are correctly fitted together and cannot be separated. At this juncture, as shown in FIG. 4, the anterior stopping protrusions 45 of the slider 41 make contact with the stoppers 29 of the female housing 20, thereby retaining the slider 41 in the anterior direction. Consequently, the slider 41 is maintained unremovably within the housing chamber 21 of the female housing 20. Furthermore, as shown in FIG. 14, the coiled springs 40 return to the original pre-fitting length.

If the two housings 10 and 20 are to be separated for maintenance or the like, the operating member 49 of the locking arm 46 is pushed, thereby releasing the fitting state of the locking protrusion 50 and the locking member 16, and allowing the two housings 10 and 20 to be pulled apart.

According to the embodiment described above, the locking arm 46 is provided in a unified manner with the slider 41. As a result, the configuration of the connector is simplified. Furthermore, since the guiding members 32 are provided, when the two housings 10 and 20 reach the correct fitting state, the locking arm 46 is bent automatically to a position where the pressed state of the locking protrusion 50 with the anterior end face 17 of the locking member 16 is released. Consequently, the slider 41 moves automatically towards the anterior. Moreover, the guiding members 32 have a dual function, being both pressing releasing means and movement guiding members. As a result, the configuration of the connector is simplified further. The portion which is pressed by the anterior end face 17 of the locking member 16 is formed as the locking protrusion 50 which fits with this locking member 16. Consequently, the configuration of the connector is simplified even more.

The regulating surfaces 34A which fit with the stopping protruding members 51 are provided below these stopping protruding members 51. As a result, the locking arm 46 is prevented from bending as fitting progresses. In the present embodiment, the bending of the locking arm 46 is used to release the slider 41 from being retained in the anterior direction. Consequently, these regulating surfaces 34A are extremely effective.

Furthermore, the present invention is not limited to the embodiments described above with the aid of figures. For example, the possibilities described below also lie within the technical range of the present invention. In addition, the present invention may be embodied in various other ways without deviating from the scope thereof.

(1) In the embodiment described above, the locking protrusion which fits with the locking member is configured so as to also be a pressing receiving member which is pressed by the male housing. However, a separate pressing receiving member may equally well be provided on the arm member.

(2) The pressing receiving member mentioned in (1) may be provided on a different part of the slider instead of on the arm member. In that case, the guiding member would only serve as the movement guiding member, and the pressing releasing means can be provided separately.

(3) The guiding member which serves as the movement guiding member in (2) causes the locking arm to bend as the two housings are fitted together. However, the movement guiding member does not necessarily need to make use of the fitting operation. In such a case, the guiding member may be omitted.

What is claimed is:

1. An electrical connector comprising a housing having an anterior side, terminals at the anterior side for engagement with a corresponding connector, and a resilient locking arm having a protrusion engageable with a corresponding connector to maintain said housing in a latched condition with a corresponding connector when fully fitted together, said housing further including a slider having an abutment for contact with a corresponding connector, said slider being movable towards and away from the anterior side, and spring means to urge the slider to the anterior side, wherein the locking arm is provided on and movable with said slider.

2. A connector according to claim 1 wherein said housing includes a guide for bending said locking arm in response to movement of said slider away from the anterior side, said guide causing said abutment to be released from contact with a corresponding connector on full engagement of said connectors, in use, such that said slider moves to the anterior under the force of said spring means, said locking arm being maintained in a bent state until engagement of said protrusion and corresponding connector.

3. A connector according to claim 1 wherein said protrusion is said abutment.

4. A connector according to claim 2 wherein said protrusion is said abutment.

5. A connector according to claim 1 wherein said guide comprises a ramp face of said housing engageable with an engagement member of said locking arm.

6. A connector according to claim 1 wherein said housing includes a supporting member engageable with said locking arm and to maintain said locking arm in the bent condition during anterior movement thereof.

7. A connector according to claim 6 wherein said engagement member contacts said supporting member during anterior movement of said locking arm.

8. A connector according to claim 6 and further including a regulating member for contact with said locking arm, and for preventing bending thereof during initial movement of said slider away from the anterior side.

9. A connector according to claim 8 wherein said regulating member and supporting member comprise opposite faces of a limb.

10. A connector according to claim 2 wherein said locking arm and guide have mutually engageable ramp faces for bending said locking arm in response to movement of said slider away from the anterior side.

11. A connector according to claim 6 wherein said locking arm and supporting member have mutually engageable ramp faces for bending said locking arm in response to movement of said slider away from the posterior side.

* * * * *